US008478184B2

(12) United States Patent
Hanashi et al.

(10) Patent No.: US 8,478,184 B2
(45) Date of Patent: Jul. 2, 2013

(54) IMAGE FORMING APPARATUS WHICH PREVENTS TONER IMAGES FROM STICKING TO EACH OTHER

(75) Inventors: Ryo Hanashi, Moriya (JP); Masahiro Komoto, Toride (JP); Hiroaki Tomiyasu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 561 days.

(21) Appl. No.: 12/178,040

(22) Filed: Jul. 23, 2008

(65) Prior Publication Data

US 2009/0028587 A1 Jan. 29, 2009

(30) Foreign Application Priority Data

Jul. 27, 2007 (JP) ..... 2007-196182

(51) Int. Cl.
*G03G 15/00* (2006.01)

(52) U.S. Cl.
USPC ..... 399/405; 399/45; 399/401

(58) Field of Classification Search
USPC ..... 399/364, 45, 401, 405
See application file for complete search history.

(56) References Cited

U.S. PATENT DOCUMENTS

| | | | | |
|---|---|---|---|---|
| 5,648,843 | A | 7/1997 | Eguchi | |
| 5,893,020 | A * | 4/1999 | Atsumi | 399/364 |
| 6,259,871 | B1 * | 7/2001 | Rider et al. | 399/92 |
| 6,788,905 | B2 | 9/2004 | Tsutada | |
| 2006/0216048 | A1 * | 9/2006 | Fujii et al. | 399/45 |

FOREIGN PATENT DOCUMENTS

| | | | |
|---|---|---|---|
| JP | 2006-243498 | A | 9/2006 |
| JP | 2006-349755 | A | 12/2006 |

OTHER PUBLICATIONS

European Patent Office, European Search Report, Nov. 25, 2008.

* cited by examiner

*Primary Examiner* — Judy Nguyen
*Assistant Examiner* — Blake A Tankersley
(74) *Attorney, Agent, or Firm* — Canon USA Inc IP Division

(57) ABSTRACT

An image forming apparatus includes a transfer unit configured to transfer a toner image based on image data onto a recording medium, a fixing device configured to thermally fix the toner image transferred onto the recording medium, a stack tray configured to stack a recording medium conveyed from the fixing device, and a controller configured to calculate based on the image data an amount of a toner on a top surface of the recording media stacked on the stack tray and an amount of a toner on a bottom surface of the recording media to be subsequently conveyed and discharged onto the stack tray and to control a recording medium discharge interval based on a result of calculating the amounts of the toners.

6 Claims, 16 Drawing Sheets

FIG.14

| | | AMOUNT OF TONER ON BOTTOM SURFACE OF DISCHARGED SHEET | | | | | |
|---|---|---|---|---|---|---|---|
| | | 0 | 1~50 | 51~100 | 101~150 | 151~200 | 201~250 |
| AMOUNT OF TONER ON TOP SURFACE OF SHEET STACK | 0 | ○ | ○ | ○ | ○ | ○ | ○ |
| | 1~50 | ○ | ○ | ○ | ○ | × | × |
| | 51~100 | ○ | ○ | ○ | × | — | — |
| | 101~150 | ○ | ○ | △ | — | — | — |
| | 151~200 | ○ | ○ | × | — | — | — |
| | 201~250 | ○ | × | — | — | — | — |

FIG.16

| OUTPUT ORDER | PAGE NUMBER | |
|---|---|---|
| 1 | P2 | n-3 |
| 2 | P1 | n-2 |
| 3 | P4 | n-1 |
| 4 | P3 | n |

IMAGE FORMING APPARATUS WHICH PREVENTS TONER IMAGES FROM STICKING TO EACH OTHER

BACKGROUND OF THE INVENTION

1. Field of the Invention

The present invention relates to an image forming apparatus configured to record a toner image on a recording medium according to image data and thermally fix the transferred toner image.

2. Description of the Related Art

In the case of a conventional image forming apparatus that thermally fixes a toner image on a recording sheet, when post-processing is performed on a recording medium, toners on recording sheets stacked on a stack tray may be mutually fused because the temperature of the recording sheets may rise due to heat fixing processing performed during the post-processing. If the toners on the recording sheets are fused, then the recording sheets stacked may adhere to each other. In this case, toner images on the recording sheets may be flaked, and as a result, poor stacking and poor sheet alignment of the recording sheets in the post-processing may occur.

Japanese Patent Application Laid-Open No. 2006-349755 discusses a method for cooling down a recording sheet before post-processing, by cooling a conveyance guiding member using a cooling fan disposed in the vicinity of a sheet discharge port. However, since the method requires a cooling mechanism between a fixing unit and a sheet discharge unit, the method cannot readily be employed in a small-sized machine, which is required to downsize the entire apparatus body and reduce costs.

Japanese Patent Application Laid-Open No. 2003-248349 (corresponding to U.S. Pat. No. 6,788,905) discusses a method for cooling a recording sheet by temporarily delaying timing for discharging onto a stack tray a recording sheet on which a toner is easily fused such as an overhead projector (OHP) film. However, according to this method, in the case of an image forming apparatus in which the toner can be fused on a plain paper, it is necessary to extend a sheet discharge time interval when post-processing is performed on the plain paper. Accordingly, it is very likely that the above-described method cannot satisfy user's desire for a high productivity.

Japanese Patent Application Laid-Open No. 2006-243498 discusses a method for detecting a density of a toner formed on a recording sheet and changing a sheet discharge interval only when the density is at a level that fusing of the toner occurs. However, the method discussed in Japanese Patent Application Laid-Open No. 2006-243498 only focuses on detecting the density of the toner on a recording sheet discharged from an image forming apparatus and cannot determine at a high accuracy whether fusing of the toner occurs.

That is, whether fusing of the toner occurs or not may depend on the density of the toner on a top surface of a recording sheet stack on a stack tray, as well as the density of the toner on the recording sheet discharged from the image forming apparatus. That is, if a large amount of toner is applied on the top surface of the recording sheet stack on the stack tray, then toner fusing easily occurs. In this case, toner images on the recording sheets may be flaked and poor stacking and poor sheet alignment may occur.

SUMMARY OF THE INVENTION

It is desirable to prevent fusing of a toner without increasing costs and sizes of the apparatus, and without reducing a productivity of the apparatus in an undesirable manner.

According to an aspect of the present invention, an image forming apparatus includes a transfer unit configured to transfer a toner image based on image data onto a recording medium, a fixing device configured to thermally fix the toner image transferred onto the recording medium, a stack tray configured to stack a recording medium conveyed from the fixing device, and a controller configured to calculate based on the image data an amount of a toner on a top surface of the recording media stacked on the stack tray and an amount of a toner on a bottom surface of the recording media to be subsequently conveyed and discharged onto the stack tray and to control a recording medium discharge interval based on a result of calculating the amounts of the toners.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIG. 14 is a table illustrating an example of a combination of an amount of a toner on a top surface of a sheet stack and an amount of a toner on a bottom surface of a discharged sheet.

FIG. 16 is a table that illustrates an example of pages and their output order.

DETAILED DESCRIPTION OF THE EMBODIMENTS

Various exemplary embodiments, features, and aspects of the present invention will be described in detail below with reference to the drawings. It is to be noted that the relative arrangement of the components, the numerical expressions, and numerical values set forth in the embodiments are not intended to limit the scope of the present invention.

An image forming apparatus according to an exemplary embodiment of the present invention can be applied to a tandem type full color printer and includes a printer unit and a post-processing apparatus.

Figure 1:
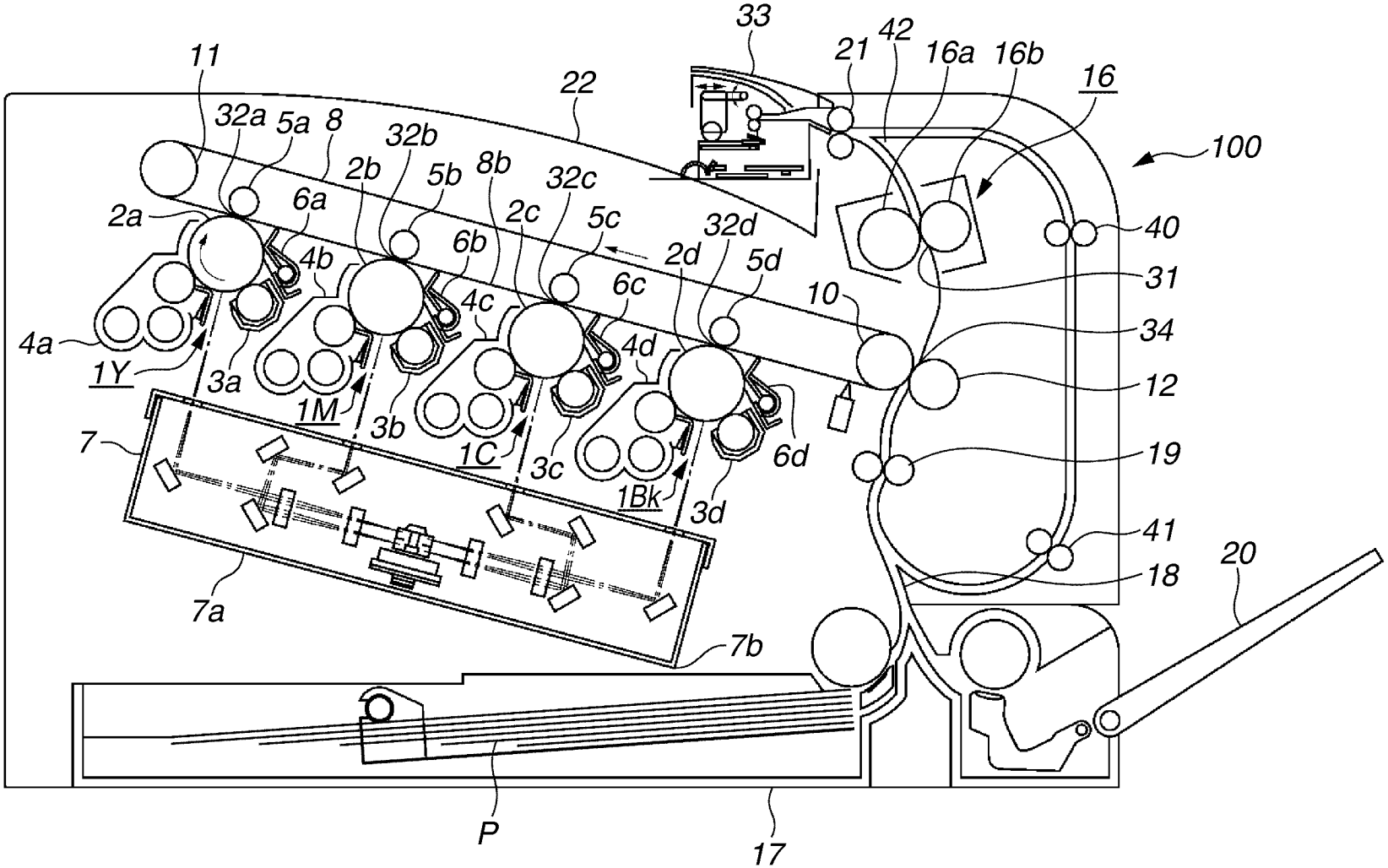
FIG. 1 is a cross section illustrating an example of an inner configuration of an image forming apparatus according to an exemplary embodiment of the present invention.

FIG. 1 is a cross section illustrating an example of an inner configuration of an image forming apparatus according to the present exemplary embodiment.

Referring to FIG. 1, an image forming apparatus 100 includes four image forming units, namely, an image forming unit 1Y, an image forming unit 1M, an image forming unit 1C, and an image forming unit 1Bk. The image forming unit 1Y forms a yellow (Y) color image. The image forming unit 1M forms a magenta (M) color image. The image forming unit 1C forms a cyan (C) color image. The image forming unit 1Bk forms a black (Bk) image. The four image forming units 1Y, 1M, 1C, and 1Bk are arranged in a straight line in a printer unit at a regular intervals.

The image forming units 1Y, 1M, 1C, and 1Bk respectively have a drum type electrophotographic photosensitive member (hereinafter referred to as a "photosensitive drum" (an image carrier)) 2*a*, 2*b*, 2*c*, or 2*d*. The photosensitive drums 2*a*, 2*b*, 2*c*, and 2*d* are collectively referred to as a photosensitive drum 2.

Around the photosensitive drums 2*a*, 2*b*, 2*c*, or 2*d*, primary charging devices 3*a*, 3*b*, 3*c*, and 3*d*, development devices 4*a*, 4*b*, 4*c*, and 4*d*, transfer rollers (transfer units) 5*a*, 5*b*, 5*c*, and 5*d*, and drum cleaning devices 6*a*, 6*b*, 6*c*, and 6*d* are respectively disposed.

Furthermore, a laser exposure device 7 is disposed below the primary charging devices 3*a*, 3*b*, 3*c*, and 3*d* and the development devices 4*a*, 4*b*, 4*c*, and 4*d*. The development devices 4*a*, 4*b*, 4*c*, and 4*d* store a yellow toner, a cyan toner, a magenta toner, and a black toner, respectively.

Each of the photosensitive drums 2*a*, 2*b*, 2*c*, and 2*d* is an organic photo conductor (OPC) photosensitive member. The photosensitive drums 2*a*, 2*b*, 2*c*, and 2*d* are negatively charged and have a photoconductive layer on a drum base made of aluminum. Each of the photosensitive drums 2*a*, 2*b*, 2*c*, and 2*d* is rotationally driven by a drive unit (not illustrated) in a clockwise direction in FIG. 1 at a predetermined process speed.

The primary charging devices 3*a*, 3*b*, 3*c*, and 3*d* uniformly charge a surface of the photosensitive drums 2*a*, 2*b*, 2*c*, or 2*d* respectively to a predetermined negative polarity potential with a charging bias applied by a charging bias power source unit (not illustrated).

The development devices 4*a*, 4*b*, 4*c*, and 4*d* cause each color toner to adhere to each electrostatic latent image which is formed on the photosensitive drums 2*a*, 2*b*, 2*c*, or 2*d* to develop (visualize) the electrostatic latent image as a toner image.

The transfer rollers 5*a*, 5*b*, 5*c*, and 5*d* are disposed to respectively contact the photosensitive drums 2*a*, 2*b*, 2*c*, and 2*d* in primary transfer sections 32*a* through 32*d* via an intermediate transfer belt 8. The drum cleaning devices 6*a*, 6*b*, 6*c*, and 6*d* include a cleaning blade for removing the transfer residual toner remaining on the surface of each photosensitive drum 2 after a primary transfer.

The intermediate transfer belt 8 is disposed above the photosensitive drums 2*a*, 2*b*, 2*c*, and 2*d* and stretched by a secondary transfer counter roller 10 and a tension roller 11.

The secondary transfer counter roller 10 is disposed in a secondary transfer section 34 to contact a secondary transfer roller 12 via the intermediate transfer belt 8. The intermediate transfer belt 8 is made of dielectric resins such as polycarbonate, a polyethylene terephthalate resin film, and a polyvinylidene fluoride resin film.

Further, the intermediate transfer belt 8 is movably disposed on an upper surface of the photosensitive drums 2*a*, 2*b*, 2*c*, and 2*d* to face them. A primary transfer surface 8*b* of the intermediate transfer belt 8 which is provided on a surface facing the photosensitive drums 2*a*, 2*b*, 2*c*, and 2*d* is inclined downward to the secondary transfer roller 12. More specifically, in the present exemplary embodiment, the intermediate transfer belt 8 is inclined downward at an angle of about 15 degrees.

The intermediate transfer belt 8 is stretched between the secondary transfer counter roller 10 and the tension roller 11. The secondary transfer counter roller 10 provides a driving force to the intermediate transfer belt 8. The tension roller 11 is disposed opposite to the secondary transfer counter roller 10 across primary transfer sections 32*a* through 32*d* and provides a tensile force to the intermediate transfer belt 8.

The secondary transfer counter roller 10 is disposed in the secondary transfer section 34 and can contact the secondary transfer roller 12 via the intermediate transfer belt 8. Further, a belt cleaning device (not illustrated) which removes and collects the transfer residual toner remaining on the surface of the intermediate transfer belt 8 is disposed outside of the endless intermediate transfer belt 8 and in the vicinity of the tension roller 11. Further, a fixing device 16 including a fixing roller 16*a* and a pressure roller 16*b* is installed on a downstream side of the secondary transfer section 34 in a conveyance direction of a recording sheet P, constituting a vertical conveyance path.

The laser exposure device 7 includes a laser light emission element, a polygon lens, and a reflecting mirror. The laser light emission element emits light corresponding to an electrical digital pixel signal which is received in a time series fashion as image information. The laser exposure device 7 exposes the photosensitive drums 2*a*, 2*b*, 2*c*, and 2*d* to laser beam to form an electrostatic latent image of each color according to image information on the surface of the photosensitive drums 2*a*, 2*b*, 2*c*, and 2*d*. The photosensitive drums are charged by primary charging devices 3*a*, 3*b*, 3*c*, and 3*d*.

Now, an image forming operation performed by the image forming apparatus having the above-described configuration is described. When a signal to start image forming is issued, the photosensitive drums 2*a*, 2*b*, 2*c*, and 2*d* of respective image forming units 1Y, 1M, 1C, and 1Bk are driven to rotate at a predetermined process speed. Furthermore, the photosensitive drums 2*a*, 2*b*, 2*c*, and 2*d* are uniformly charged to a negative polarity by the respective primary charging devices 3*a*, 3*b*, 3*c*, and 3*d*.

The laser exposure device 7 emits laser beam from the laser light emission element according to a color-separated image signal which is externally input. The emitted laser beam reaches each surface of the photosensitive drums 2*a*, 2*b*, 2*c*, and 2*d* via the polygon lens and the reflection mirrors to form an electrostatic latent image of respective color thereon.

The development device 4*a* receives a development bias of the same polarity as the charging polarity of the photosensitive drum 2*a* (negative polarity). Further, the development device 4*a* causes the yellow toner to adhere to the electrostatic latent image on the photosensitive drum 2*a* to visualize the image as a toner image.

The yellow toner image is primarily transferred on the driven intermediate transfer belt 8 by the transfer roller 5*a* to which a primary transfer bias (having a polarity reverse to the polarity of the toner (namely, a positive polarity)) is applied at the primary transfer section 32*a* disposed between the photosensitive drum 2*a* and the transfer roller 5*a*. The intermediate transfer belt 8 having the transferred yellow toner image is moved toward the image forming unit 1M.

In the image forming unit 1M, similar to the processing performed by the image forming unit 1Y, a magenta toner image formed on the photosensitive drum 2*b* is superimposed on the yellow toner image on the intermediate transfer belt 8 and transferred thereto at the primary transfer section 32*b*.

Likewise, a cyan toner image and a black toner image which are formed on the photosensitive drum 2*c* and the photosensitive drum 2*d* in the image forming units 1C and 1Bk respectively, are serially superimposed by each of the primary transfer sections 32*c* and 32*d* on the yellow and the magenta toner images which have been transferred on the intermediate transfer belt 8.

Thus, a full color toner image is formed on the intermediate transfer belt 8. At this time, the transfer residual toner remaining on the photosensitive drum 2 is scraped off and collected by the cleaner blade of cleaning devices 6*a*, 6*b*, 6*c*, and 6*d*.

The recording sheet P is conveyed to the secondary transfer section 34 by a registration roller 19 in synchronization with timing at which a leading edge of the full color toner image on the intermediate transfer belt 8 reaches the secondary transfer section 34. The secondary transfer section 34 is disposed between the secondary transfer counter roller 10 and the secondary transfer roller 12.

The recording sheet P is fed from a paper feed cassette 17 or a manual feed tray 20 to the registration roller 19 via a conveyance path 18. The full color toner image is secondarily transferred in a lump by the secondary transfer roller 12 onto the recording sheet P which is conveyed to the secondary transfer section 34. To the secondary transfer roller 12, a secondary transfer bias is applied with a polarity reverse to the polarity of the toner (i.e., a positive polarity).

When the recording sheet P having the full color toner image is conveyed to the fixing device 16, the full color toner image is applied with heat and pressure in a fixing nip portion between the fixing roller 16*a* and the pressure roller 16*b* to be thermally fixed on the surface of the recording sheet P.

Then, the recording sheet P is conveyed by a paper discharge roller 21 to enter into a post-processing apparatus 33, which will be described below. Then, the recording sheet P is discharged on a sheet discharge tray 22 which is disposed on a top of the printer unit. Then, a series of image forming operations ends. The second transfer residual toner left on the intermediate transfer belt 8 is removed and collected by the belt cleaning device (not illustrated).

Figure 2:
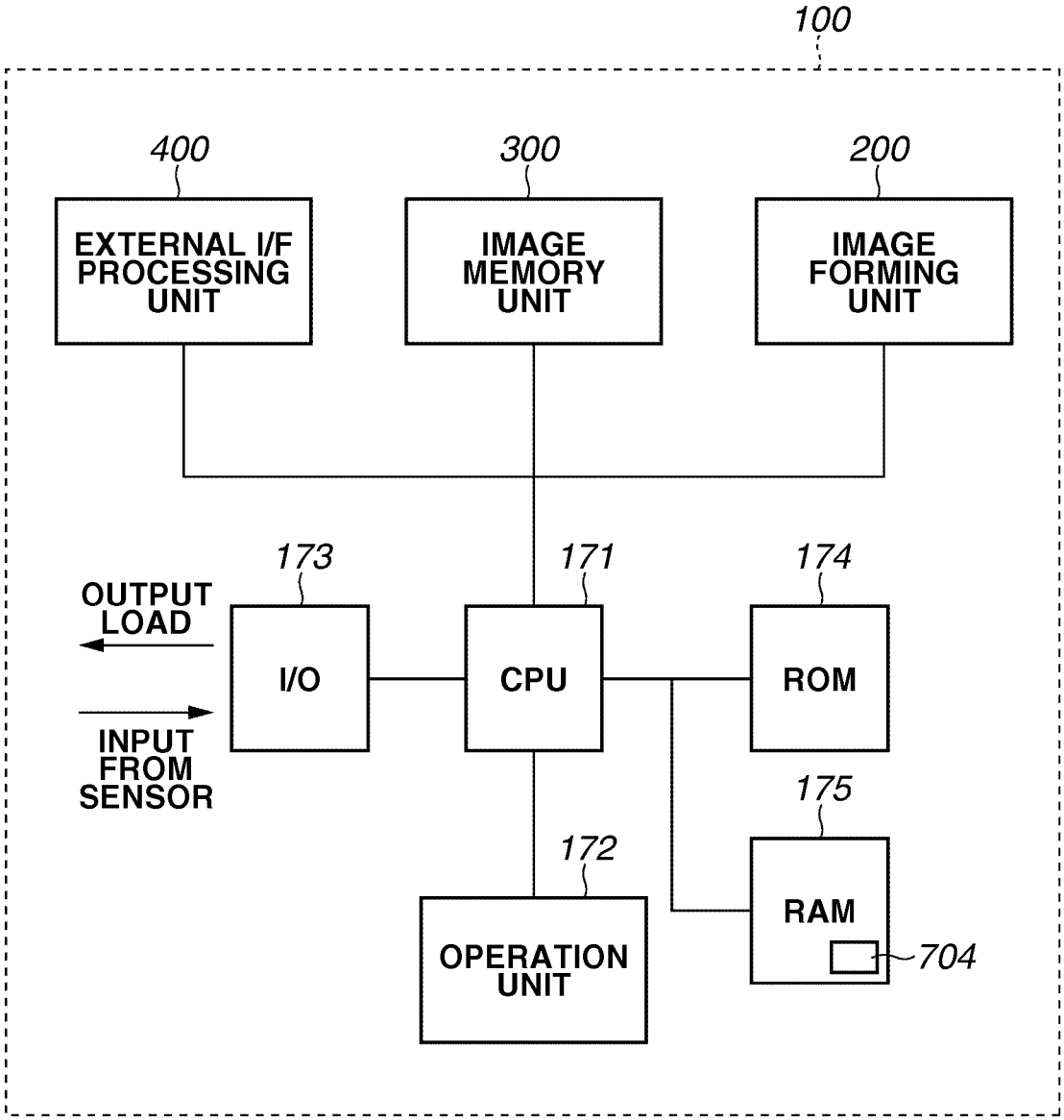
FIG. 2 illustrates an example of a configuration related to control of a printer unit of the image forming apparatus.

FIG. 2 illustrates an exemplary configuration related to control of the printer unit of the image forming apparatus 100 according to the present exemplary embodiment.

Referring to FIG. 2, a central processing unit (CPU) 171 performs basic control of the image forming apparatus 100. Further, the CPU 171 is connected to a read-only memory (ROM) 174 storing a control program, a work random access memory (RAM) 175, and an input/output (I/O) port 173 via an address bus and a data bus.

Various loads, such as a motor and a clutch (not illustrated), and an input portion of a sensor (not illustrated) for detecting a paper position, which are used for controlling the image forming apparatus 100, are connected to the I/O port 173.

The CPU 171 serially performs input and output control via the I/O port 173 according to a content of the control program stored on the ROM 174, to perform an image forming operation. Further, a memory area 704, which will be described below, is allocated on the work RAM 175.

An operation unit 172 is connected to the CPU 171. The CPU 171 controls a display unit and a key input unit disposed in the operation unit 172.

A user instructs the CPU 171 to switch an image forming operation mode or a display screen via the key input unit. Upon receiving the instruction, the CPU 171 displays status information about the image forming apparatus 100 or the operation mode set by the user via the key input unit.

An external interface (I/F) processing unit 400, an image memory unit 300, and an image forming unit 200 are connected to the CPU 171.

The external I/F processing unit 400 sends and receives image data and data to be processed from an external apparatus such as a personal computer (PC). Further, the external I/F processing unit 400 performs a serial communication with the post-processing apparatus 33.

The image memory unit 300 performs image decompressing processing and temporary storing of image data. The image forming unit 200 includes the above-described image forming units 1Y, 1M, 1C, and 1Bk. The image forming unit 200 causes the laser exposure device 7 to perform exposure according to line image data transferred from the image memory unit 300.

As described above, the laser exposure device 7 emits a laser beam from the laser light emission element thereof according to the color-separated image signal that is externally input. The emitted laser beam reaches the surface of each photosensitive drum 2*a*, 2*b*, 2*c*, and 2*d* via the polygon lens and the reflection mirrors to form an electrostatic latent image of respective color thereon.

Figure 3:
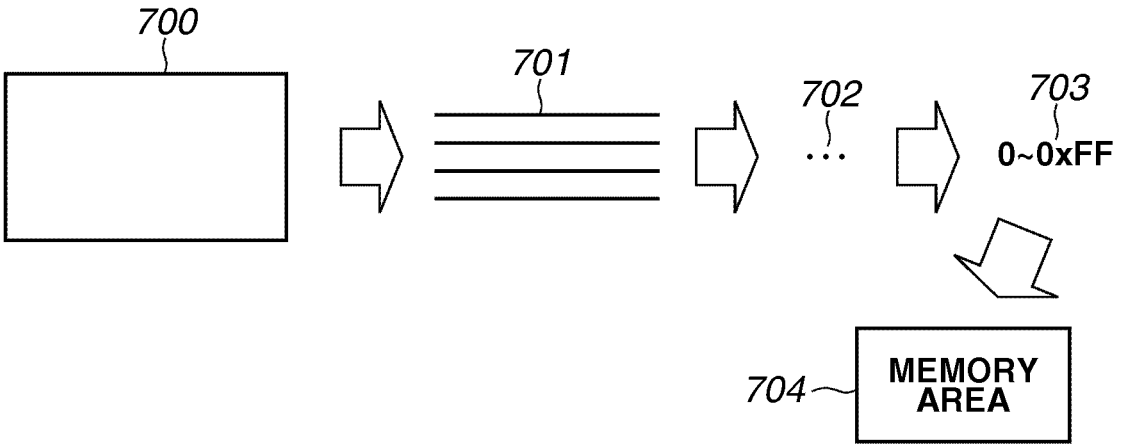
FIG. 3 illustrates an example of a toner image.

FIG. 3 illustrates an example of a toner image. Referring to FIG. 3, a toner image 700 formed on each page is an aggregate of lines 701 obtained by scanning with the laser beam. If the toner image 700 is further magnified, the line 701 is seen as an aggregate of dots 702 which are formed by a waveform of the laser beam.

Figure 4:
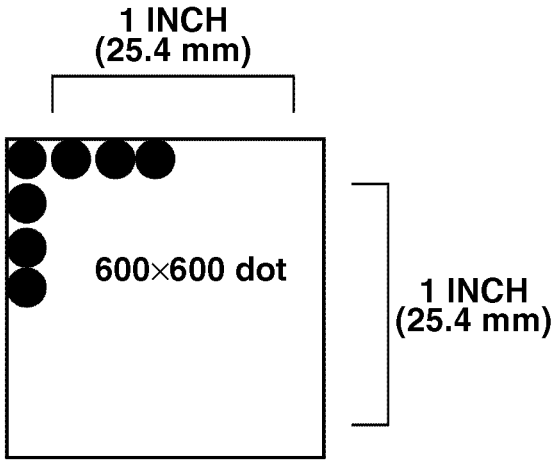
FIG. 4 illustrates an example of a default toner image.

The present exemplary embodiment can form six hundred dots per inch as a default resolution. FIG. 4 illustrates an example of a default toner image.

Each of the dots 702 is formed based on a video signal value 703. The video signal value 703 has sixteen different levels whose value ranges from 0 to 15 (0xFF). An output image density varies according to a level of the video signal value 703. Accordingly, data based on the video signal value 703 can be obtained per dot.

By integrating and storing the video signal values 703 per dot on the memory area 704 during emitting of the laser, image information for one page, which is an aggregate of dots, can be obtained.

Figure 5:
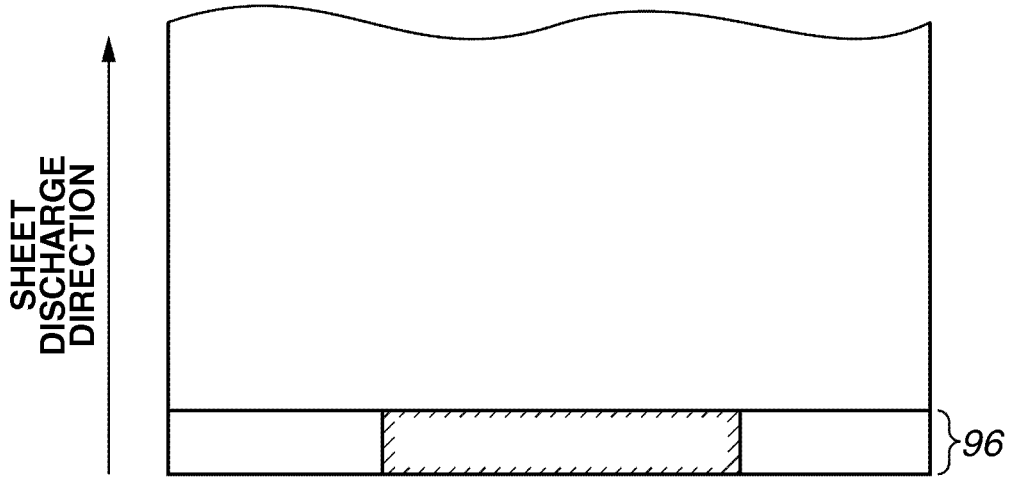
FIG. 5 illustrates an example of the toner image on a trailing edge portion of a recording sheet.

FIG. 5 illustrates an example of a toner image on a trailing edge portion of a recording sheet. For example, toner image information in an image trailing edge portion 96 can be obtained at a position of 50 mm from a trailing edge of an A3-size paper (297 mm×420 mm). In addition, a hatched area of the portion 96 is an area where sorting member 62 (FIG. 7) touches the recording sheet, and the width of the hatched area is about 150 mm.

Figure 6:
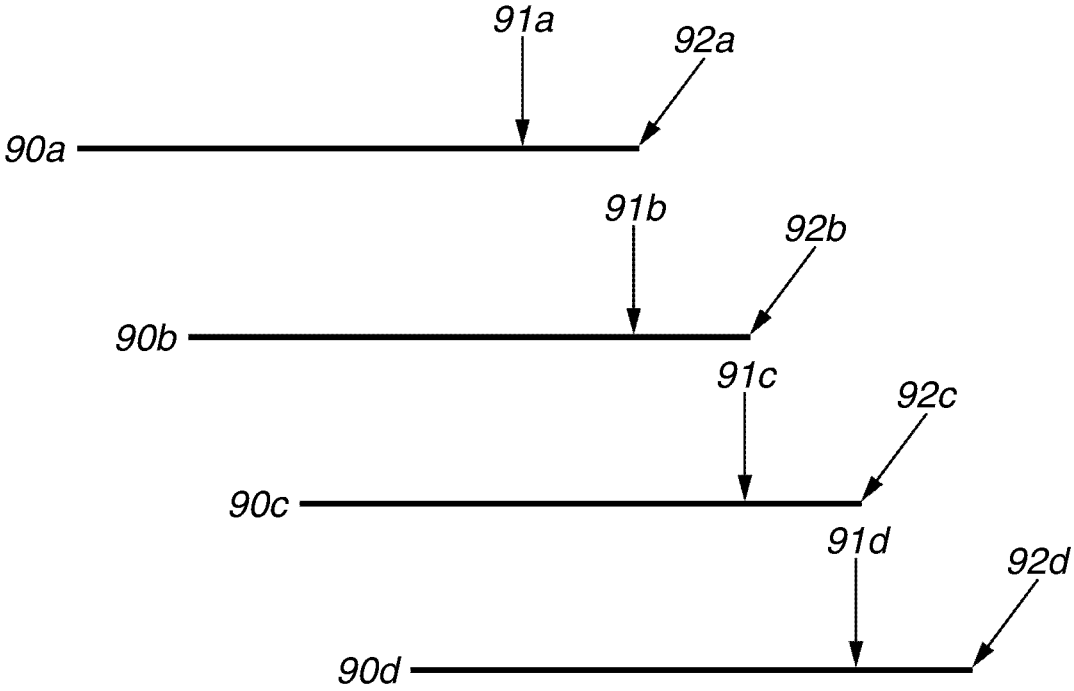
FIG. 6 illustrates an example of toner image information acquisition processing.

FIG. 6 illustrates exemplary processing for acquiring toner image information.

Referring to FIG. 6, the CPU 171 starts video signal addition processing for each dot with respect to each color (C, M, Y, and K) from leading edge portions 90*a* through 90*d*, which respectively correspond to C, M, Y, and K color images, to the memory area 704. The CPU 171 acquires addition data for the memory area from the leading edge position 90*a* to dot position 91*a* for the color Y. In a case of an image forming apparatus having a resolution of 600 dots per inch (dpi), since 1 inch is equivalent to 25.4 mm, the area from the leading edge position 90*a* to the position 91*a* has "600×(420−50)/25.4" dots. After that, the CPU 171 acquires addition data for the memory area from the leading edge position 90*a* to trailing edge position 92*a* for the color Y. Further, the density for the color Y at the position of 50 mm from the trailing edge of the image can be acquired based on a subtraction the addition data of the area from the leading edge position 90*a* to the position 91*a* from the addition data of the area from the leading edge position 90*a* to trailing edge position 92*a*. The same is true for other colors M, C and Bk. The CPU 171 calculates a total density at the image trailing edge portion 96 by summing the addition data of Y, M, C and K at the image trailing edge portion 96.

By changing the timings for acquiring the addition data for the memory area 704, the CPU 171 can change the area of the toner image for which the toner image information is acquired. The portion can be of any suitable length in a sheet conveyance direction. As explained later, in one embodiment, the portion of the toner image for which the toner image information is acquired corresponds to a leading edge portion of the recording sheet.

Figure 7:
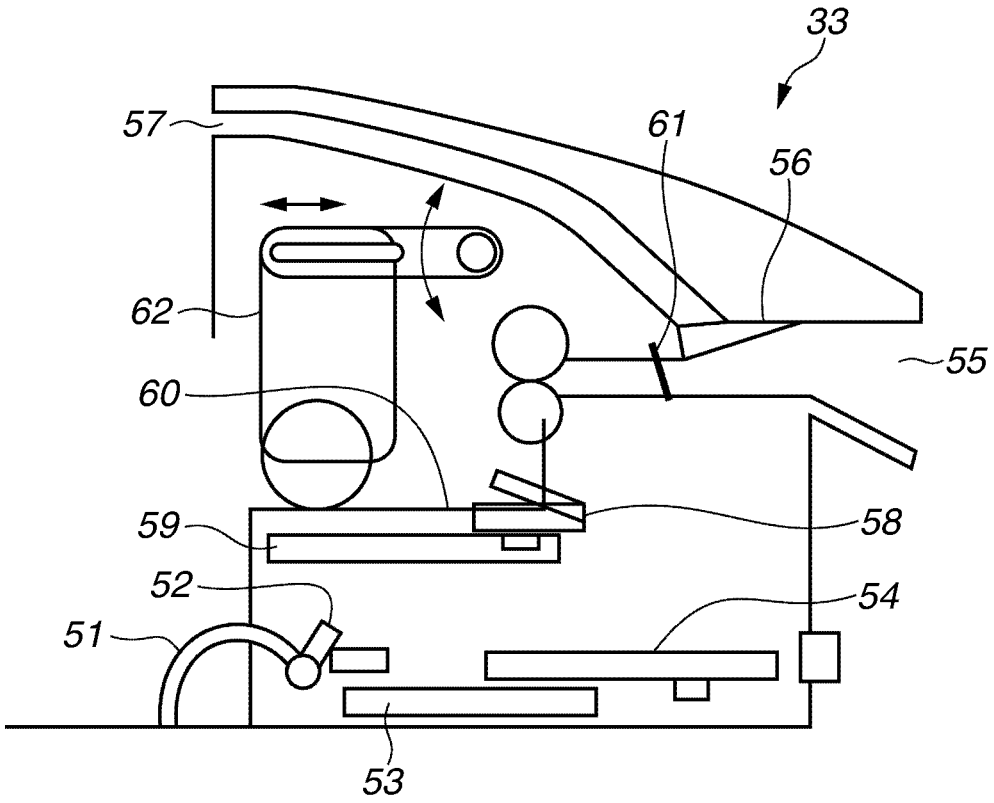
FIG. 7 is a cross section illustrating an example of an inner configuration of a post-processing apparatus.
Figure 8:
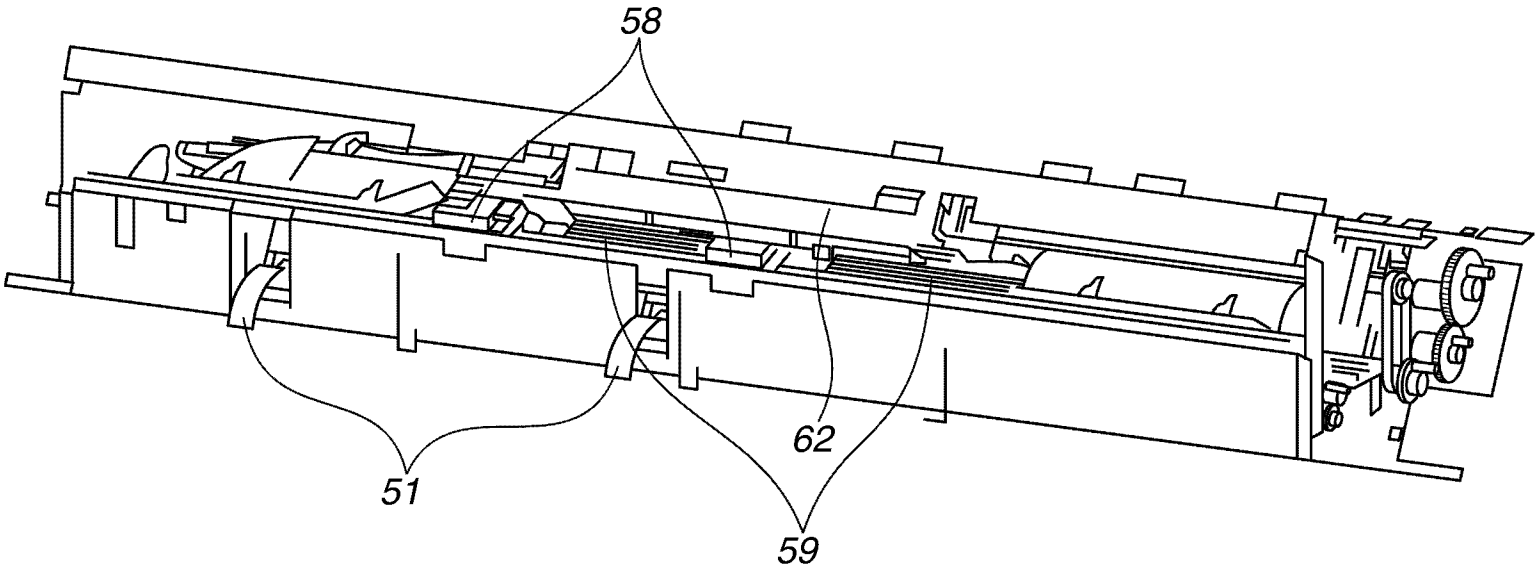
FIG. 8 illustrates an exemplary configuration of the post-processing apparatus viewed from a sheet discharge port of the image forming apparatus.

Now, the post-processing apparatus 33 is explained in detail. FIG. 7 is a cross section illustrating an exemplary inner configuration of the post-processing apparatus 33. FIG. 8 illustrates an exemplary configuration of the post-processing apparatus 33 viewed from a sheet discharge port. Referring to FIG. 7, the paper entrance portion (a conveyance path) 55 is disposed facing the paper discharge roller 21 of the printer unit so that a sheet discharged by the paper discharge roller 21 can enter the post-processing apparatus 33 via the conveyance path 55.

During processing for receiving the sheets discharged from the printer unit, the post-processing apparatus 33 performs a serial communication with the printer unit via a communication connector. Thus, the post-processing apparatus 33 can operate in synchronization with the operation of the printer unit.

Figure 9:
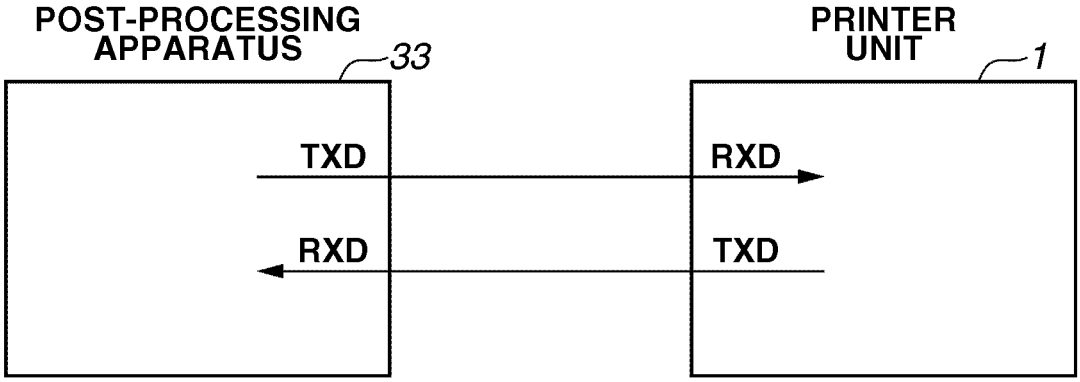
FIG. 9 illustrates an example of a communication connection between the post-processing apparatus and a printer unit.

FIG. 9 illustrates an exemplary communication connection between the post-processing apparatus 33 and a printer unit 1. Referring to FIG. 9, the post-processing apparatus 33 includes a communication connector. The communication connector includes a data sending terminal TXD and a data receiving terminal RXD which are respectively connected to a data receiving terminal RXD and a data sending terminal TXD of the printer unit 1.

A sensor 61 detects an entrance of a sheet from the conveyance path 55. The sheet entering the post-processing apparatus 33 from the conveyance path 55 is stacked on a stack tray 60. Recording sheets stacked on the stack tray 60 are aligned by a sorting member 62 in a direction perpendicular to the sheet discharge direction (namely, in a sorting direction).

Figure 10:
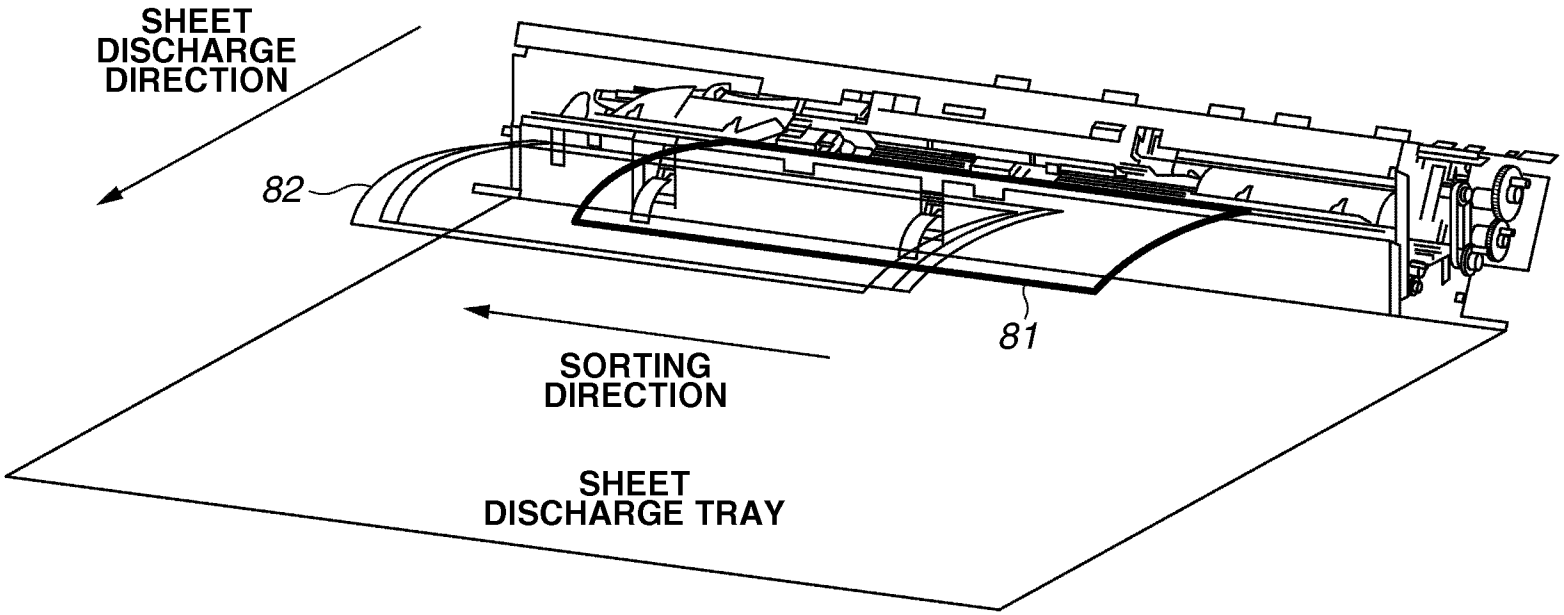
FIG. 10 illustrates an example of a sorting position for sorting recording sheets.

FIG. 10 illustrates an example of a sorting position for sorting the recording sheets. Referring to FIG. 10, recording sheets 81 which are output from the printer unit 1 are aligned in the sorting direction. After a predetermined number of sheets are stacked on the stack tray 60 (as indicated by a sheet stacking state 82), the stacked sheets are stapled by a stapler (not illustrated) as necessary. Then, the stapled sheet stack is discharged by a sheet stack discharge slider 58.

The stack discharge slider 58 is driven by a stack discharge slider extruding member 59. The stack discharge slider extruding member 59 is connected to a sheet holding claw drive gear 54 via a connection member (not illustrated) to drive a sheet holding member 51.

The sheet holding member 51 holds the discharged sheets to reduce curling of thermally fixed sheets.

A full-stack detection flag 52 works with the sheet holding member 51. A full-stack detection sensor 53 detects a full stacking of sheets on the sheet discharge tray 22 by detecting a position of the sheet holding member 51 and a thickness of the discharged sheets on the sheet discharge tray 22.

In the case of a two-sided image forming operation as described below, sheets are conveyed to a conveyance path 57 and reversed by operating a conveyance path switching member 56.

Now, a sheet alignment operation performed by the post-processing apparatus 33 will be described.

Figure 11A:
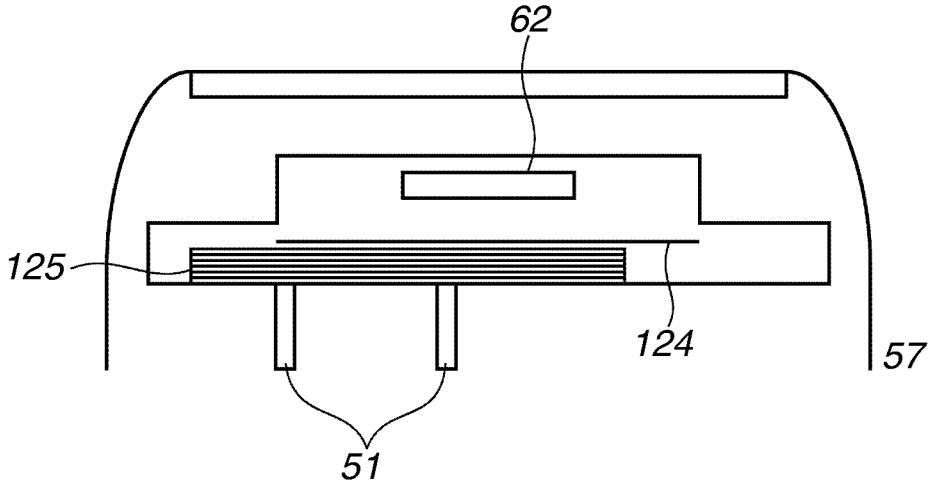
FIG. 11A illustrates an example of an operation of a sorting member.
Figure 11B:
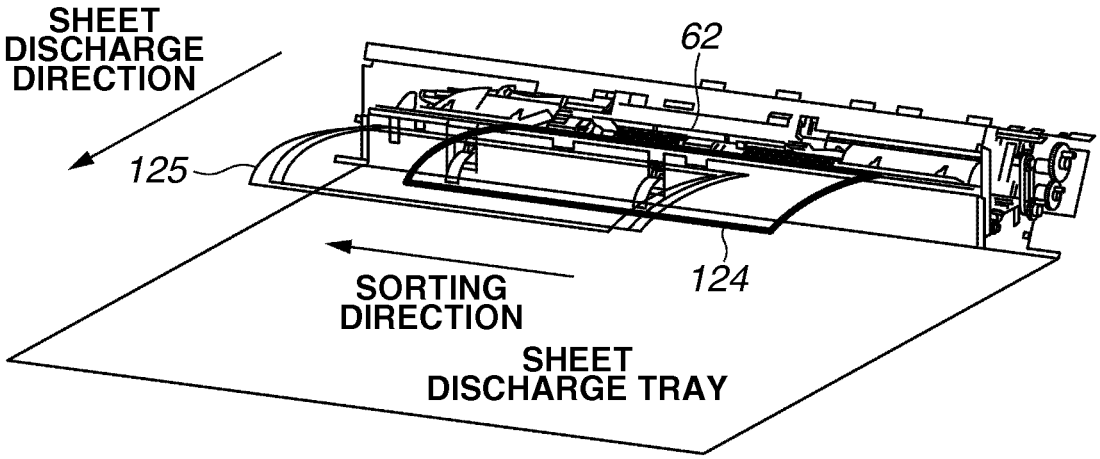
FIG. 11B illustrates an example of an operation of a sorting member.
Figure 12A:
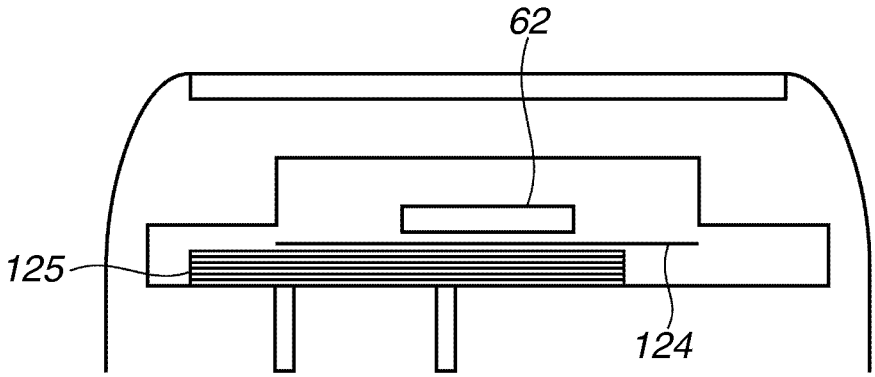
FIG. 12A illustrates an example of an operation of a sorting member.
Figure 12B:
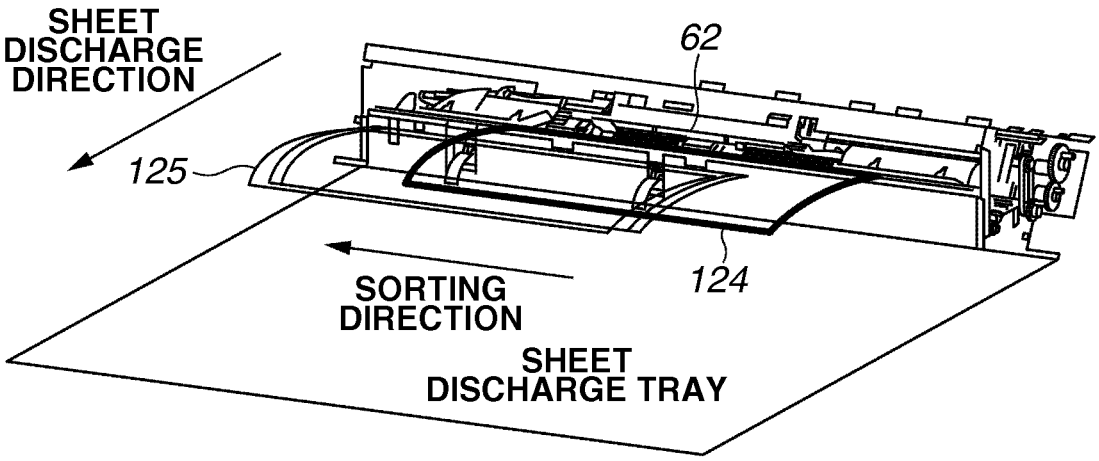
FIG. 12B illustrates an example of an operation of a sorting member.
Figure 13A:
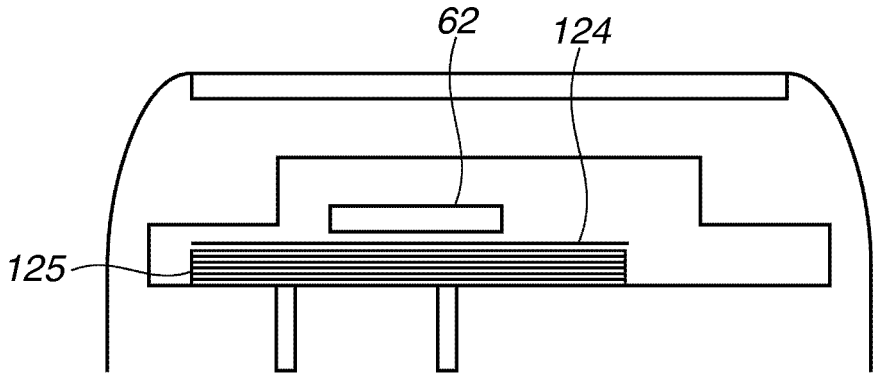
FIG. 13A illustrates an example of an operation of a sorting member.
Figure 13B:
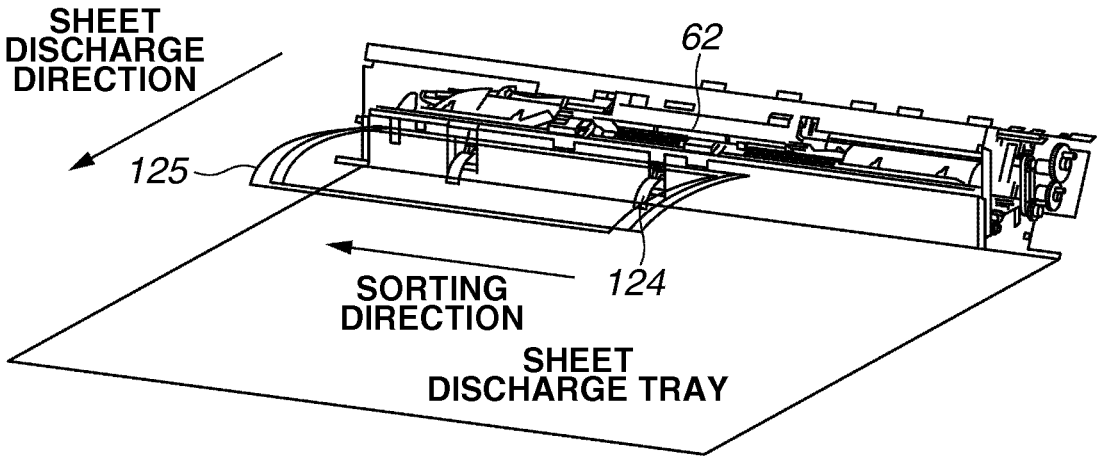
FIG. 13B illustrates an example of an operation of a sorting member.

FIGS. 11A, 12A, and 13A illustrate an example of a configuration of the post-processing apparatus 33 in the vicinity of the sorting member 62 viewed from a sheet discharge side of the post-processing apparatus 33. FIGS. 11B, 12B, and 13B illustrate an example of a configuration of the post-processing apparatus 33 in the vicinity of the sorting member 62 viewed obliquely from above the post-processing apparatus 33.

Referring to FIGS. 1A through 13B, the sorting member 62, the sheet holding member 51, a sheet to be discharged 124, and stacked sheets 125 waiting for being stapled are illustrated.

When the sheet to be discharged 124 is discharged, the sorting member 62 descends from a position illustrated in FIG. 11A to a position illustrated in FIG. 12A to contact the sheet. The sorting member 62 which contacts the sheet moves in the sorting direction while contacting the sheet to be discharged 124 to align the sheet 124 to be discharged with the stacked sheets 125, as illustrated in FIG. 13A.

The sheet to be discharged 124 that moves in the sorting direction is stacked on the stacked sheets 125 waiting to be stapled until the number of the stacked sheets 125 reaches a predetermined number of sheets for stapling. When the number of the stacked sheets 125 reaches the predetermined number of sheets for stapling, the stacked sheets 125 are stapled and discharged.

The two-sided image forming (a two-sided printing mode) in the image forming apparatus of the present exemplary embodiment is described next.

In the two-sided image forming, the same processing as a one-sided image forming mode (a one-sided mode) is performed until a full color toner image on the recording sheet P is thermally fixed by the fixing device 16.

When the full color toner image has been applied with heat and pressure to be thermally fixed on a first surface of the recording sheet P in the fixing nip portion between the fixing roller 16*a* and the pressure roller 16*b*, most of the recording sheet P is already discharged onto the sheet discharge tray 22 by the paper discharge roller 21, but the trailing edge of the sheet P has still not yet reached the paper discharge roller 21. In this state, the paper discharge roller 21 stops its rotation. At this timing, the trailing edge of the recording sheet P reaches a reversing position 42. At some earlier time, the conveyance path switching member 56 of the post-processing apparatus 33 was operated, so that when the sheet P reaches the post-processing apparatus 33 it is conveyed to the conveyance path 57, as described above.

Subsequently, the paper discharge roller 21 is rotated in a direction opposite to a normal rotational direction to convey the recording sheet P, whose conveyance has been suspended after the rotation of the paper discharge roller 21 is stopped, into a reversing print path having print rollers 40 and 41. By reversely rotating the paper discharge roller 21, the recording sheet P, which has been positioned at the reversing position 42, reaches the print roller 40 with its trailing edge now being a leading edge thereof.

Then, the recording sheet P is conveyed to the print roller 41 by the roller 40. The recording sheet P is conveyed to the registration roller 19 by the series of print rollers 40 and 41. During the conveyance of the recording sheet P to the registration roller 19, a signal to start an image forming operation is generated to perform an image forming on the second surface of the sheet P. The image forming operation for the second surface is similar to that of one-sided image forming.

That is, the registration roller 19 moves the recording sheet P to the secondary transfer section 34 in synchronization with the timing that the leading edge of the full color toner image on the intermediate transfer belt 8 reaches the secondary transfer section 34 which is disposed between the secondary transfer counter roller 10 and the secondary transfer roller 12.

After the leading edge of the toner image and the leading edge of the recording sheet P are mutually aligned and the toner image is transferred onto the second surface of the recording sheet P, the image transferred onto that surface of the recording sheet P is fixed by the fixing device 16, similar to the one-sided image forming operation. The recording sheet P is again conveyed by the paper discharge roller 21 to enter the post-processing apparatus 33 and discharged onto the sheet discharge tray 22. Thus, the double-sided image forming operation ends.

The fixing device 16 melts the toner and fixes it onto a sheet by passing the sheet having the toner through the fixing nip portion in a closely contacted manner and applying heat and pressure to the toner.

During the fixing operation, the fixing device 16 provides heat to not only the toner but also to the sheet itself. Thus, the temperature of the sheet rises. In particular, in the case of the two-sided printing mode in which the sheet once having passed through the fixing device passes therethrough again, the temperature of the sheet being discharged rises as high as 60° C. to 80° C. Accordingly, the temperature of the fixed toner surface may only slowly drop, and thus the toner may contact the already discharged sheet in a viscous state.

In this case, if a toner-applied area of the already discharged and stacked sheet is large, then the contact resistance between the stacked sheet and the discharged sheet may become so great that the stacked sheet may be moved from its position as the sheet is discharged. Further, if the amount of moving of the stacked sheet is large, an output quality may be degraded when a document including a plurality of sheets is output. Particularly in stapling a sheet stack, missing pages may easily occur in this case.

According to a study by the inventor of the present invention, it was found that a poor sheet alignment may occur due to a combination of the amount of toner on the top surface of the sheet stack and the amount of toner at the bottom surface of the discharged sheet and a size of an area of the sheet applied with toner.

More specifically, if the toner area in the leading edge portion on the bottom surface of the discharged sheet contacts the toner area on the top surface of the sheet stack, the viscous toner may cause the discharged sheet to contact the stacked sheet ("toner fusing"). If a sheet is discharged in a state where the leading edge thereof contacts the stacked sheet, then the stacked sheet is moved from its position. Thus, the poor sheet alignment may occur.

However, even if the discharged sheet has much toner on central portion in the conveyance direction, an effective frictional force may become small due to paper stiffness and holding of the paper by the roller at the trailing edge. Accordingly, the amount of toner in this case is not so much related to the poor sheet alignment. Therefore, in the present exemplary embodiment the amount of the toner in an area on the bottom surface of the discharged sheet from the leading edge of the image area to the position of 80 mm therefrom is used to determine whether the poor sheet alignment may occur.

FIG. 14 is a table illustrating an example of the combination of the amount of toner on the top surface of the sheet stack (first measure of toner amount) and the amount of toner on the bottom surface of the discharged paper (second measure of toner amount).

The table is stored on the ROM 174. In the image forming apparatus of the present exemplary embodiment, in the case where only one color image is formed, a toner amount of 100% can be applied on an image surface at the maximum. On the other hand, in the case where full color toner image is formed, a toner amount of 250% can be applied on an image surface at the maximum, i.e. each of the first and second measures is at most 250%.

The table illustrated in FIG. 14 has circles in all rows of the first column. This is because, in the case where the toner amount on the bottom surface of the discharged sheet was 0%, it was found empirically that the poor sheet alignment did not occur even when the toner amount on the top surface was the maximum of 250%.

In the case where the toner amount on the bottom surface of the discharged sheet was 1 to 50%, it was found empirically that the poor sheet alignment did not occur until the sum of the amount of toner on the top surface of the sheet stack and the amount of toner on the bottom surface of the discharged paper reached 250%. In the case where the amount of toner on the bottom surface of the discharged paper was 51 to 100%, it was found empirically that poor sheet alignment definitely occurred when the toner amount on the top surface was 151 to 200%. Also, even if the amount of toner on the top surface of the sheet stack was 101 to 150%, then it was found empirically that the sheet was slightly poorly aligned (see the case indicated with a triangle in FIG. 14).

In the case where the amount of toner on the bottom surface of the discharged paper was 101 to 150% or 151 to 200%, if the sum of the amount of toner on the top surface of the sheet stack and the amount of toner on the bottom surface of the discharged paper was 200% or lower, the poor sheet alignment did not occur. If the sum of the amount of toner on the top surface of the sheet stack and the amount of toner on the bottom surface of the discharged paper was higher than 200%, the poor sheet alignment occurred. Moreover, in the case where the amount of toner on the bottom surface of the discharged paper was 201 to 250%, if any toner adhered to the sheet stack top surface, the poor sheet alignment occurred. However, if the amount of toner on the bottom surface of the discharged paper was 0%, that is, in the case of a solid white image, no poor sheet alignment occurred.

Thus, it can be observed from the above-described empirical results that the sum of the amount of toner on the top surface of the sheet stack and the amount of toner on the bottom surface of the discharged paper influences whether a poor sheet alignment occurs during the two-sided image forming operation. Further, the amount of toner on the bottom surface of the discharged paper affects an occurrence of the poor sheet alignment more than the amount of toner on the top surface of the sheet stack. For example, in the case where the amount of toner on the top surface of the sheet stack is 200% and the amount of toner on the bottom surface of the discharged paper is 50%, the poor sheet alignment may not occur (see the case indicated by a circle in FIG. 14). However, in the case where the amount of toner on the top surface of the sheet stack is 50% and the amount of toner on the bottom surface of the discharged paper is 200%, then the poor sheet alignment may occur (see the case indicated with a cross in FIG. 14).

In the case of the two-sided image forming operation, the page numbers allocated to a document including a plurality of pages, which are generated by the user, and a sheet output order of the image forming apparatus do not always match. Now, this possible difference between the page order of the document and the sheet output order is described using the image forming apparatus 100 in FIG. 1 as an example.

After an image is transferred onto the sheet P set in the paper feed cassette 17 at the secondary transfer section 34, the sheet P passes through the fixing device 16, and is discharged onto the sheet discharge tray 22. At this time, the sheet P is discharged so that a first surface of the sheet, on which the image has been formed, is placed face-down. In the two-sided printing mode, the sheet P is switched back by the paper discharge roller 21, passes through the rollers 40 and 41, passes through the secondary transfer section 34 and the fixing device 16 again, and is discharged. At this time, the sheet P is discharged so that a second surface is placed face-down and the first surface face-up.

Figure 15:
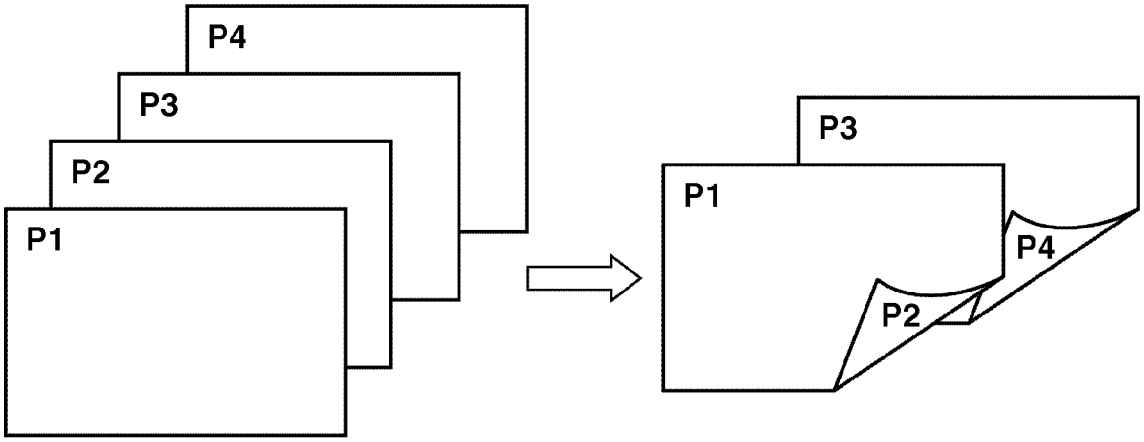
FIG. 15 illustrates an example of a relationship between pages and stacked sheets.
Figure 15:
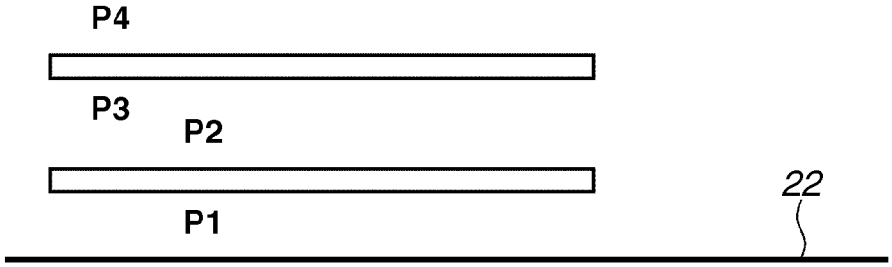

FIG. 15 illustrates pages and a sheet stacking state. Referring to FIG. 15, in the case where a document made up of four pages P1 through P4 is printed in the two-sided printing mode onto two sheets, the pages P1, P2, P3, and P4 are stacked in this order from the bottom on the sheet discharge tray 22. In this case, the pages are output by the image forming apparatus in the order of the page P2 first, the page P1, the page P4, and the page P3, as illustrated in FIG. 16.

FIG. 16 is a table illustrating pages and their output order. The relationship between a density (equivalent to the toner amount discussed above) of the first image to be output (page P2) and a density of the fourth image to be output (page P3) is significant in terms of poor sheet alignment.

The image forming apparatus according to the present exemplary embodiment therefore controls a sheet discharge interval based on a relationship between a density value V(n) of an n-th image in the series of images and a value V(n−3) of an (n−3)-th image in the series. Here, a density value denotes density of a predetermined portion of the image (a density signal value equivalent to the toner amount).

Figure 17:
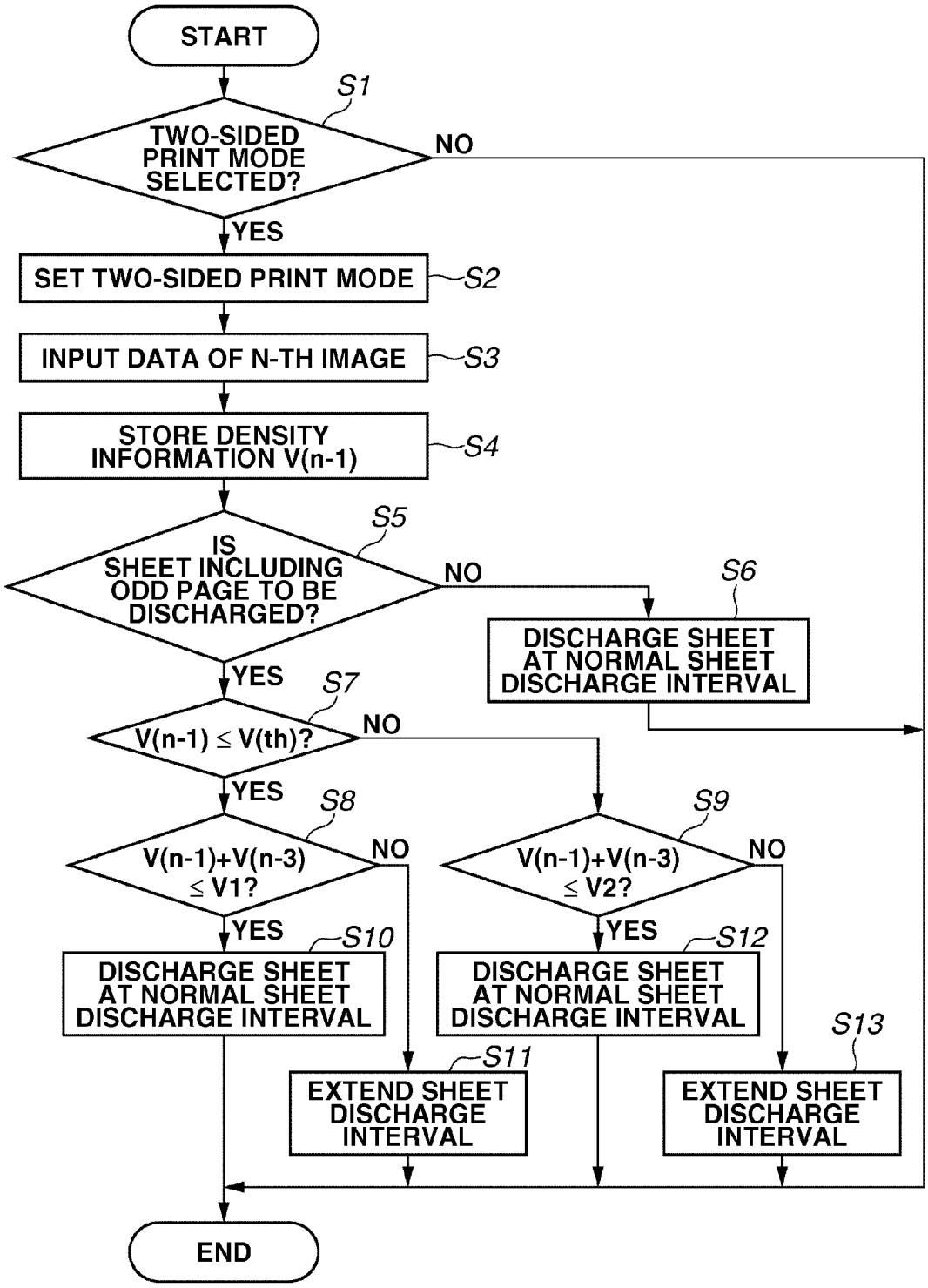
FIG. 17 is a flow chart illustrating an example of the sheet discharge control processing based on density information when a two-sided image is formed.

FIG. 17 is a flow chart illustrating exemplary processing for controlling the sheet discharge order according to information about the density in the case of two-sided image forming. A control program for performing the processing of the flow chart is stored on the ROM 174 and executed by the CPU 171.

Referring to FIG. 17, in step S1, the CPU 171 determines whether a two-sided printing mode is selected by the user via the operation unit 172. If it is determined in step S1 that a one-sided printing mode is selected instead of a two-sided printing mode (NO in step S1), then the CPU 171 ends the processing.

On the other hand, if it is determined in step S1 that the two-sided printing mode is selected (YES in step S1), then the processing advances to step S2. In step S2, the CPU 171 sets the two-sided printing mode on the image forming apparatus.

In step S3, the CPU 171 inputs data of an n-th image in the two-sided printing mode. In step S4, the CPU 171 calculates the density signal value V(n), which is image density information for the n-th image, and stores a result of the calculation in the memory area 704. The memory area 704 can store density data for a plurality of different images.

The CPU 171 calculates, as the density signal value (toner amount) V(n), the toner amount in the area corresponding to a leading edge portion of the sheet in the sheet discharge direction. This leading edge portion is the portion of the sheet that is likely to affect the sheet alignment accuracy (in the present exemplary embodiment, the leading edge portion is the portion from the leading edge of the sheet to the position of 80 mm therefrom). Further, the toner amount for the entire image area is calculated at the same time. [why?]

In the present exemplary embodiment, a series of sheets are printed on both surfaces and then stacked one upon another. When a further recording sheet of the series is stacked on top of one or more preceding recording sheet a bottom surface of that further recording sheet comes into contact with a top surface of an uppermost one of the preceding recording sheets of the series. The poor sheet alignment may occur when a sheet having an image on the bottom surface, namely an odd-numbered page, is output for stacking.

In step S5, the CPU 171 determines whether the next sheet to be discharged (i.e. stacked) has an odd-numbered page on its bottom surface. If it is determined in step S5 that the next sheet to be discharged has an even-numbered page on its bottom surface (NO in step S5), then in step S6 the CPU 171 discharges the sheet at a normal sheet discharge interval from the preceding sheet and ends the processing.

On the other hand, if it is determined in step S5 that the next sheet to be discharged has an odd-numbered page on its bottom surface, the processing advances to step S7. In step S7, the CPU 171 classifies the pages into ranks based on the density signal values Vn for the corresponding pages. the CPU 171 determines whether the density signal value V(n) of the bottom surface of the sheet to be discharged paper equal to or less than a toner density threshold value Vth.

In the present exemplary embodiment, the toner density threshold value Vth for the bottom surface of the sheet to be discharged is set at "50" based on the results in FIG. 14. Here, "Vsum" denotes a sum of the amount of toner V(n) on the bottom surface of the sheet to be discharged and the amount of toner V(n−3) on the top surface of the sheet stack. It will be appreciated that V(n−3) is a first measure of the toner amount and V(n) is a second measure of the toner amount. The first measure relates to an amount of toner in the toner image formed on the top surface of the uppermost sheet on the stack. The second measure relates to an amount of toner in the toner image formed on the bottom surface of the next sheet to be discharged. The first measure V(n−3) is the density value for the (n−3)-th image. This first measure V(n−3) was calculated in a previous iteration of the operations shown in FIG. 17. In that previous iteration the data of the (n−3)-th image was received (S3) and the density value V(n−3) for that image was calculated and stored in the memory area 704 (S4). The value V(n−3) is then retrieved from the memory area 704 and used as the first measure when processing steps S8 and S9 in the current iteration.

If it is determined in step S7 that $V(n) \leqq Vth$ (YES in step S7), then the processing advances to step S8. In step S8, the CPU 171 determines whether the sum Vsum of the second measure (amount of toner V(n) on the bottom surface of the discharged paper) and the first measure (amount of toner V(n−3) on the top surface of the sheet stack) is equal to or less than a predetermined threshold value V1. In the present exemplary embodiment, the threshold value V1 is set to 250(%).

If it is determined in step S8 that Vsum≦V1 (YES in step S8), then the processing advances to step S10. In step S10, the CPU 171 sets the normal sheet discharge interval and ends the processing.

On the other hand, if it is determined in step S8 that the total value Vsum>V1 (NO in step S8), then the processing advances to step S11. In step S11, the CPU 171 sets an extended sheet discharge interval. Thus, the toner layer can be cooled down, and as a result, the poor sheet alignment can be suppressed. Then, the CPU 171 ends the processing.

On the other hand, if it is determined in step S7 that the second measure (amount of toner V(n) on the bottom surface of the sheet to be discharged) exceeds the toner density threshold value Vth (=50) (NO in step S7), then the processing advances to step S9. In step S9, the CPU 171 determines whether the total value Vsum is equal to or less than the predetermined threshold value V2. In the present exemplary embodiment, the threshold value V2 is set at 200(%).

If it is determined in step S9 that Vsum≦V2 (YES in step S9), then the processing advances to step S12. In step S12, the CPU 171 sets the normal sheet discharge interval and ends the processing.

On the other hand, if it is determined in step S9 that the total value Vsum>V2 (NO in step S9), then the processing advances to step S13. In step S13, the CPU 171 sets the extended sheet discharge interval. Thus, the toner layer can be cooled down, and as a result, the poor sheet alignment can be suppressed. Then, the CPU 171 ends the processing.

During the extended sheet discharge interval mode in steps S11 and S13, the printer unit (the external I/F processing unit 400) sends a signal to the post-processing apparatus 33 (see FIG. 9).

More specifically, in the extended sheet discharge interval mode, the post-processing apparatus 33 is placed on standby. While the post-processing apparatus 33 is on stand-by, the sheet is slightly reversed by the paper discharge roller 21, and the sheet discharge interval is changed for each page so that the sheet to be discharged may not contact the sheet stacked on the stack tray 60. The time period for the standby is necessary to cool down the sheet and is about four seconds in the present exemplary embodiment.

Figure 18:
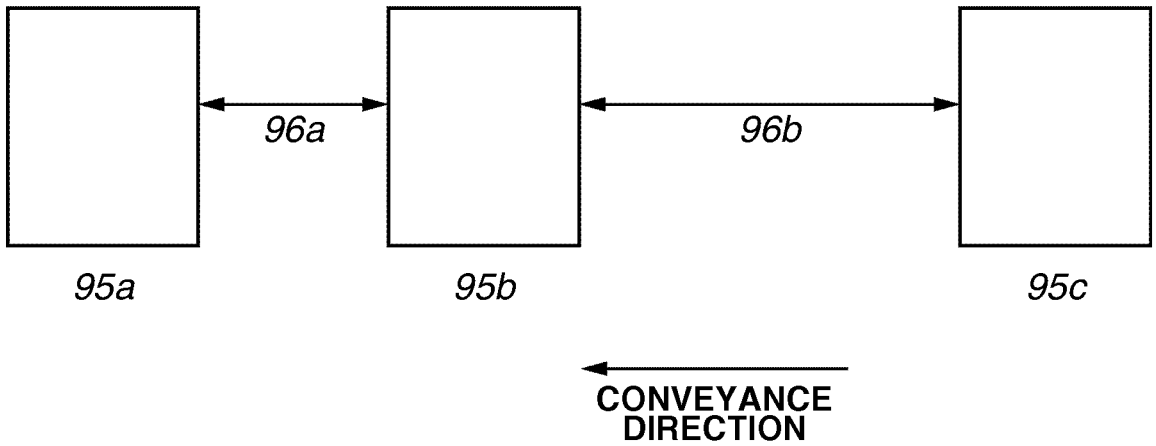
FIG. 18 illustrates an example of a sheet discharge interval.

FIG. 18 illustrates a sheet discharge interval for sheets 95*a* through 95*c*.

If the total value Vsum exceeds the threshold value while the sheets are conveyed at the normal sheet discharge interval 96*a*, a sheet discharge interval 96*b* is extended to be longer than the normal sheet discharge interval 96*a* so that the interval between the sheets becomes longer than the predetermined amount of time. In the normal conveyance of the sheet, the sort member 62 contacts the sheet immediately after the trailing edge of the sheet, which enters the post-processing apparatus 33 from the conveyance path 55, reaches the stack tray 60 (namely, immediately after the discharged sheet is completely stacked on the stack tray 60) to move the sheet to the sorting direction.

However, if the total value Vsum exceeds the threshold value, then toner fusing is likely to occur. Accordingly, the printer unit sends a signal to the post-processing apparatus 33 to instruct extending of the sheet discharge interval to delay the timing of contact of the sorting member 62 on the sheet.

The above-described processing can keep the discharged sheet having a large amount of toner from adhering to the sheet already stacked on the stack tray. Further, using the total value Vsum of the amount of toner can prevent the poor sheet alignment due to toner fusion more accurately.

In the image forming apparatus of the present exemplary embodiment, the total value of the amount of toner on the bottom surface of the sheet to be discharged and the amount of toner on the top surface of the sheet stack is considered to influence the poor sheet alignment in the two-sided printing mode. Further, the amount of toner on the bottom surface of the sheet to be discharged is considered to affect the sheet alignment accuracy more than the amount of toner on the top surface of the sheet stack.

Moreover, in the case of using a video count method, each surface of the series of sheets on which a toner image is formed is considered. For each surface toner image information is obtained for a relevant portion of the surface, for example a portion of suitable length in the conveyance direction. The toner image information is obtained, for example, by summing, in the memory area 704, the video signal values (addition data) of all dots in an area of the image corresponding to the relevant portion of the surface. The relevant portion can be changed by changing the timing for acquiring the addition data in the memory area. Thus, the image forming apparatus of the present exemplary embodiment sums the video signal values of a predetermined area of the image (the area ranging from the leading edge of the image area on the bottom surface of the discharged sheet to the position of 80 mm from the leading edge) and obtains the toner image information (first and second measures) from the sum. [Again, it should be explained if there is a sum per color, or an overall sum for all colors.}

The image forming apparatus of the present exemplary embodiment refers to image density information about the top surface of the sheet already discharged and stacked on the stack tray. Thus, the image forming apparatus employs the image density information about the top surface of the stack of sheets (first measure) and the image density information about the bottom surface of the sheet that is currently being discharged (second measure) to decide how to control the sheet discharge interval. As a result, the first and second measures are both employed to control a timing at which a recording sheet is discharged and stacked by said stacking means.

Thus, the present exemplary embodiment can provide the image forming apparatus that can avoid poor sheet alignment as well as the reduction of its productivity without causing substantial costs. Further, the image forming apparatus according to the present exemplary embodiment can prevent toner images from flaking off the sheet.

As described above, the image forming apparatus according to the present exemplary embodiment can prevent toner fusing in each recording sheet without raising the costs, increasing size of an apparatus, or unnecessarily reducing the productivity. Accordingly, according to the present exemplary embodiment, a high usability can be achieved. Furthermore, the present exemplary embodiment can prevent poor sheet alignment when recording media have a large amount of toner, by delaying the sheet alignment operation by the sorting member 62.

In the present exemplary embodiment, the image density information is calculated based on a dot ratio. However, the present invention is not limited to this method for acquiring the image density information. That is, the same effect as described above can be achieved by calculating the image density information directly from the image information. The present invention is applied to a full color tandem type engine in the present exemplary embodiment. However, the present invention is not limited to the full color tandem type. That is, the present invention can also be applied to a monochromatic printer or a single-drum full color engine.

In the above-described exemplary embodiment, the same areas in the entire image area on the top surface of the sheet stack and the bottom surface of the discharged sheet are used to calculate the total value of the toner amount. However, the area whose toner amount is calculated can be different between the top surface of the sheet stack and the bottom surface of the discharged sheet. Thus, an area affecting the sheet alignment accuracy can be set in more detail. Accordingly, the present exemplary embodiment can achieve a more appropriate control on a sheet discharge interval.

Furthermore, the present invention can be applied to a system including a plurality of devices or to an apparatus including one device. Moreover, the image forming apparatus according to the present exemplary embodiment can be any of a printing apparatus, a facsimile apparatus having a printing function, or a multifunction peripheral (MFP) having a printing function, a copy function, and a scanner function.

In the above-described exemplary embodiment of the present invention, the image forming apparatus uses the intermediate transfer member and can serially transfer toner images of respective colors onto the intermediate transfer member and transfer the toner images carried on the intermediate transfer member at the same time. However, the present invention is not limited to this transfer method. That is, the present invention can be applied to an image forming apparatus that uses a recording medium carrying member and serially transfers toner images of respective colors on a recording medium carried by the recording medium carrying member in a mutually overlapping manner.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-196182 filed Jul. 27, 2007, which is hereby incorporated by reference herein in its entirety.

What is claimed is:

1. An image forming apparatus comprising:

an image forming unit configured to form toner images onto a recording sheet based on image data;

a fixing device configured to thermally fix the toner image onto the recording sheet;

a stack tray which a recording sheet conveyed from the fixing device is discharged to and the recording sheet discharged is stacked on; and a controller configured to compute an amount of a toner on a first surface of a first recording sheet to be stacked on the stack tray and an amount of a toner on a second surface of a second recording sheet to be stacked on the stack tray subsequent to the first recording sheet when a two-sided printing mode in which images are formed on two sides of a recording sheet is set, the second surface of the second recording sheet coming into contact with the first surface of the first recording sheet on the stack tray, and to control a recording sheet discharge interval between discharging the first recording sheet onto the stack tray and discharging the second recording sheet onto the stack tray based on a combination of computed amounts of toners on the first surface and on the second surface, wherein, in order to determine the recording sheet discharge interval, the controller compares a total value of the amount of the toner on the first surface of the first recording sheet and the amount of the toner on the second surface of the second recording sheet with a second threshold value in a case where the amount of the toner on the second surface of the second recording sheet is equal to or smaller than a first threshold value, and the controller compares the total value with a third threshold value smaller than the second threshold value in a case where the amount of the toner on the second surface of the second recording sheet is larger than the first threshold value.

2. The image forming apparatus according to claim 1, wherein when a total value of the amount of the toner on the first surface of the first recording sheet and the amount of the toner on the second surface of the second recording sheet exceeds a threshold value, the controller extends the recording sheet discharge interval so as to be larger than when the total value does not exceed the threshold value.

3. The image forming apparatus according to claim 1, further comprising a toner amount storage memory configured to store an amount of a toner on each surface of each recording sheet computed by the controller.

4. The image forming apparatus according to claim 1, wherein the controller computes an amount of toner in a predetermined area on a leading edge side of each recording sheet in a conveyance direction of the recording sheet.

5. The image forming apparatus according to claim 1, wherein the controller does not perform a control operation to extend the recording sheet discharge interval based on the computed amounts of toner, when the two-sided printing mode is not set.

6. The image forming apparatus according to claim 1, further comprising a post-processing unit configured to perform post-processing on the recording sheet stacked on the stack tray.

* * * * *